United States Patent [19]

Lawall et al.

[11] Patent Number: 4,708,644

[45] Date of Patent: Nov. 24, 1987

[54] APPARATUS FOR ROASTING FINE GRAINED MATERIAL

[75] Inventors: Thomas R. Lawall, Emmaus; Stephen A. Lukacz, Nazareth, both of Pa.

[73] Assignee: Fuller Company, Bethlehem, Pa.

[21] Appl. No.: 883,420

[22] Filed: Jul. 8, 1986

[51] Int. Cl.[4] ..... F27B 7/02

[52] U.S. Cl. ..... 432/106; 432/58; 432/14

[58] Field of Search ..... 432/106, 14, 58

[56] References Cited

U.S. PATENT DOCUMENTS

| | | | |
|---|---|---|---|
| 3,904,353 | 9/1975 | Bosshard et al. | 432/14 |
| 4,201,546 | 5/1980 | Herchenbach et al. | 432/58 |
| 4,270,900 | 6/1981 | Shy et al. | 432/106 |
| 4,298,340 | 11/1981 | Herchenbach et al. | 432/106 |
| 4,381,916 | 5/1983 | Warshawsky | 432/14 |
| 4,425,092 | 1/1984 | Brachthause et al. | 432/106 |
| 4,490,109 | 12/1984 | Krutzner | 432/106 |
| 4,530,661 | 7/1985 | Herchenbach et al. | 432/106 |
| 4,557,688 | 12/1985 | Nielsen | 432/14 |
| 4,568,276 | 2/1986 | Fujisawa | 432/14 |

*Primary Examiner*—Henry C. Yuen

*Attorney, Agent, or Firm*—Frank H. Thomson

[57] ABSTRACT

An improved apparatus for roasting fine material which includes recirculation of at least partially roasted material through the roasting furnace for further roasting. An adjustable gate is included in the recirculation system for controlling the quantity of material recirculated. A high temperature fluidizing gravity conveyor is used in the recirculation system to maintain a low profile for the system. The invention utilizing a system for classifying large particles so that they may be removed from the recirculation system. Gas locks are included for preventing the short circuiting of hot gases. The system also includes overflow conduit in the event of a plug or blockage in the system.

12 Claims, 3 Drawing Figures

19
19
11
12
15
10
16
I
11
13
10
17
II
11
10
12
III
16
17
1
IV
22
21
17
20
V
2
10
24
25
13
16
27
48
49
7
35
3
33
48
47
31
43
30
32
41
45
4
42
44

13

70
72
71
73
7
90
76
75
92
78
35
31
80
76
35
75
73
78
72
71

APPARATUS FOR ROASTING FINE GRAINED MATERIAL

BACKGROUND OF THE INVENTION

This invention relates to apparatus for roasting or calcining fine grained material such as cement raw meal, limestone or dolomite and has particular application in a cement producing system utilizing a suspension-type preheater, a stationary calcining furnace and a separate clinkering furnace followed by a cooler.

The present invention is an improvement over U.S. Pat. No. 4,381,916 issued May 3, 1983. In that patent, it is disclosed that it is desirable in an ore roasting apparatus similar to the present invention to recirculate material to be roasted or calcined through the calcining furnace of the apparatus. In that patent there is disclosed a suspension-type preheater followed by a separate calcining furnace followed by a clinkering furnace and a cooler. Cement raw meal or other material to be roasted is preheated in the preheater, then supplied to the calcining furnace. Material discharged from the calcining furnace is supplied to a separate processer such as the clinkering furnace while a portion of it is recirculated back to the calcining furnace for further calcining. The advantage of such a system is that the fine material to be calcined or roasted is exposed to the temperature in the calciner for a greater period of time so that a higher percentage of material is calcined at a given temperature.

According to the present invention, a practical apparatus has been provided for carrying out the process disclosed in the aforementioned U.S. patent.

In cement clinker producing plants and in other thermal processing installations, large pieces of material such as pieces of broken refractory, tramp iron and the like can work its way through a preheater to plug downstream apparatus. These large chunks of material should be separated from the system or they will plug the recirculation system. It is best if these oversized particles can be supplied directly to the kiln.

It is also known that in material roasting systems such as those to which the present invention relates that due to the sticky nature of the intermediate material, plugging of the system can occur and it is necessary to provide a by-pass system around the recirculation system in the event of such plugging.

SUMMARY

It is the principal object of this invention to provide an apparatus for roasting fine grained material such as cement raw meal, lime, or dolomite which will improve the operating characteristics of a recirculating calcining system thereby improving the operation of the roasting apparatus.

The foregoing and other objects will be carried out by providing apparatus for roasting fine grained material such as cement raw meal, lime or dolomite comprising a furnace having an inlet for gas for combustion, an inlet for raw fine grained material to be roasted, an inlet for fuel for combustion in said furnace and an outlet for spent combustion gas and at least partially roasted fine grained material; a gas-solids separator having an inlet for spent combustion gas and at least partially roasted fine grained material flow connected to the outlet of said furnace, an outlet for separated at least partially roasted fine grained material and an outlet for separated spent combustion gas; means for recirculating a portion of the least partially roasted fine grained material from the outlet for separated at least partially roasted fine grained material of said gas-solids separator to said furnace; and for discharging the remainder of the at least partially roasted fine grained material; and means for by-passing material around said means for recirculating a portion of the material for discharging the by-passed material from the system.

According to the present invention, an arrangement has been provided which permits particle size classification so that in the event large chunks of material are discharged from the calcining vessel, they may be discharged from the calcining system without recirculation. This is carried out by the utilization of strategically located grizzly bars. These oversized particles are discharged from the calcining system. In a cement clinker application, they are supplied to the clinkering furnace.

Also according to the present invention, gas locks are provided in the recirculation conduit and in the conduit for oversized material so that the intended gas flow is not short circuited around the calcining system.

A low profile for the system is maintained by using a high temperature fluidizing gravity conveyor in the recirculation system.

BRIEF DESCRIPTION OF THE DRAWING

The invention will be described in connection with the annexed drawing wherein.

DESCRIPTION OF THE PREFERRED EMBODIMENT

Figures 1, 2, 3:
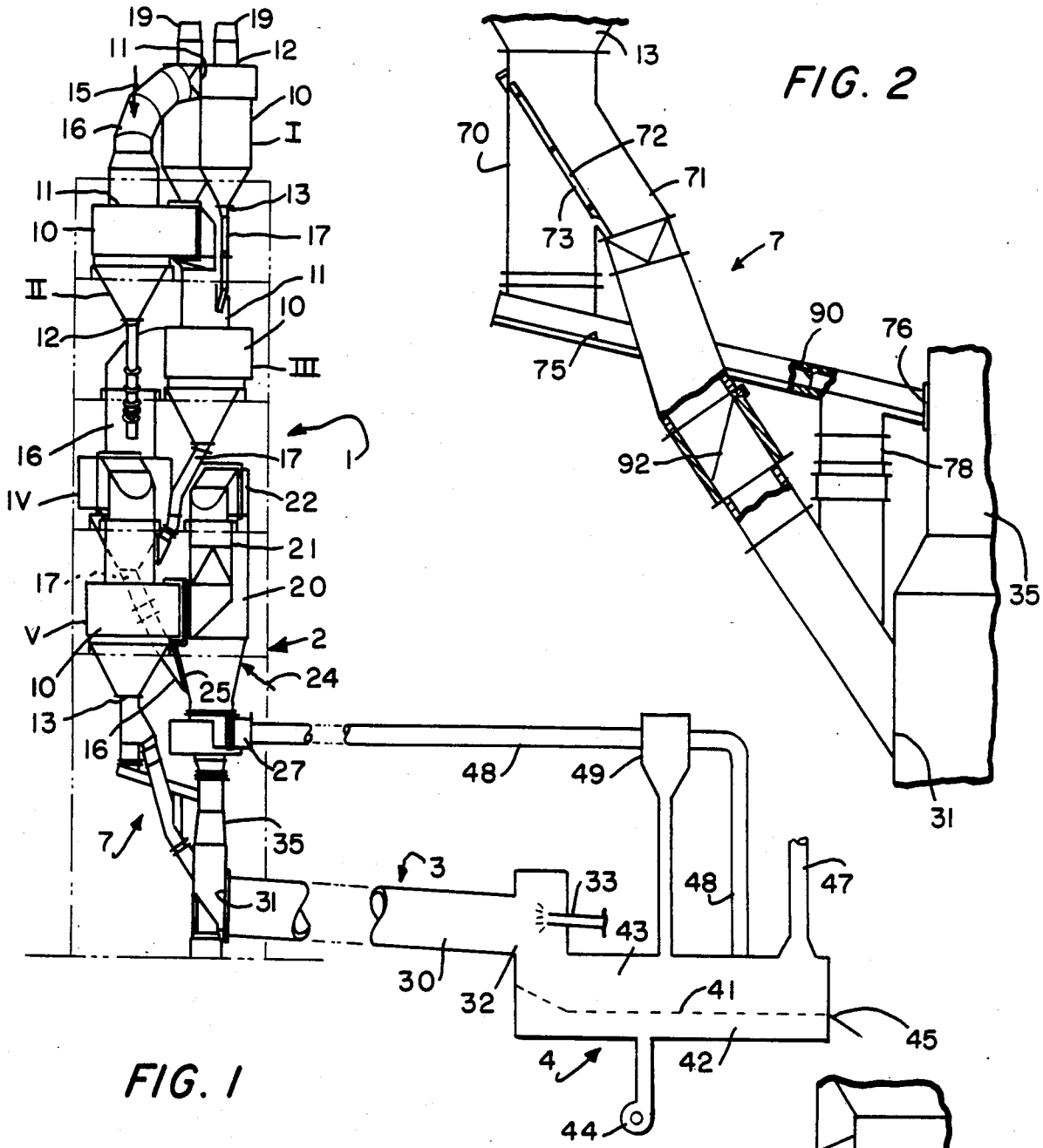
FIG. 1 is a diagramatic view of a cement manufacturing facility utilizing the present invention.
FIG. 2 is a view on an enlarged scale of a portion of the recirculation system of the present invention.
FIG. 3 is a top view of the recirculation system shown in FIG. 2 with parts broken away for clarity.

Referring to the drawing, the invention is described in connection with a cement manufacturing facility which includes a preheater generally indicated at 1, a calcining furnace means generally indicated at 2, a clinkering furnace generally indicated at 3 and a cooler generally indicated at 4. Each of these components is generally known in the art and need not be described in detail.

The preheater includes of a plurality of serially connected gas-solids separators of the cyclone type each indicated at 10. Each of these cyclones 10 has an inlet 11 for gas and entrained material, an outlet 12 for separated gas and an outlet 13 for separated solids. The system includes an inlet 15 for raw material to be treated. A gas conduit 16 flow connects the gas outlet 12 of each cyclone with the gas inlet 11 of the next higher cyclone. A material duct 17 connects the material outlet 13 of each cyclone 10 with the conduit 16 of the next lower cyclone. Material supplied from the conduit 17 to the conduit 16 is entrained in hot gas being discharged from the lower cyclone 10 and supplied to the upper cyclone 10 where the gas and solids are separated so that heat from the hot gas is transferred to the material as the material flows downwardly generally countercurrent to the upward gas flow through the preheater in a manner well known in the art.

Generally in the art, the various cyclones are referred to as preheater stages. In the drawing illustrated, a five-stage preheater is utilized with stage I being illustrated as the uppermost cyclone 10 and stage V being the lowermost cyclone with intermediate stages II, III and IV. Spent preheating gas in discharged from the preheater 1 through outlet 19 to a high efficiency dust collector (not shown).

The calcining furnace means 2 includes a stationary calcining furnace 20 and the gas solids separator 10 which forms stage V of the preheater. A duct 21 connects the outlet 22 of furnace 20 with the stage V cyclone 10. The furnace 20 also includes burner means 24 so that combustion takes place in the calcining furnace means 2. Preheated material to be processed is supplied by the material duct 17 from the stage IV cyclone to the material inlet 25 of the calcining furnace means 2 and vessel 20 where it is exposed to the combustion in the furnace 20 for calcining or roasting the material. Spent combustion gas and entrained at least partially calcined material is discharged from the furnace 20 and supplied through the outlet 22 and duct 21 to the stage V cyclone 10. The outlet 13 for at least partially calcined material of the stage V cyclone serves as the material outlet of the calcining furnace means 2. The gas outlet 12 of the stage V cyclone 10 serves as the gas outlet of the calcining means 2 for supplying preheated gas to the preheater 1.

The apparatus also includes a clinkering furnace such as a rotary kiln 30 having an inlet 31 for calcined material to be clinkered and an outlet 32 for clinkered material. The rotary kiln 30 includes a burner means 33 for burning fuel in the clinkering furnace 3 to complete the clinkering process.

The system also includes a clinker cooler generally indicated at 4 which is preferably of the reciprocating grate type generally known in the art. This type of cooler includes a gas permeable grate 41 dividing the cooler into a lower plenum chamber 42 and an upper material chamber 43 and serves as a means for moving the clinker from the inlet 32 to the outlet 45. Cooling air is supplied from a source such as a fan 44 to the undergate compartment 42 for passage through the reciprocating grates 41 and bed of material supported thereon to simultaneously cool the material and heat the air.

Some to the air which is heated by the hot clinker is supplied directly to the rotary kiln to serve as preheated combustion air in the kiln. Other spent cooler gas is supplied through duct 48 and a gas solid separator 49 to the calcining furnace 2 through combustion air inlet 27 of the calcining furnace means 2 to serve as preheated combustion air for the calciner 2. The cooler 4 also includes a vent duct 47 which supplies excess cooling air to a high efficiency dust collector (not shown).

The clinkering furnace 3 includes a riser duct 35 flow connecting the clinkering furnace to the calcining furnace 2 so that exhaust gas from the kiln is supplied to the calcining furnace 2 and then the preheater 1.

Referring now to FIGS. 2 and 3, the recirculation system of the present invention is generally indicated at 7. The recirculation system 7 includes a duct 70 which is connected to the outlet 13 of the stage V cyclone 10 of the calcining means 2. The duct 70 also includes a branch 71 with a particle size classifying means 72 positioned between the duct 70 and the duct 71. This particle size classifying means is preferably in the form of grizzly bars 73 in (FIGS. 2 and 3). The grizzly bars remove oversize material which cannot pass between the bars so that this oversize material may be discharged from the calcining furnace through duct 71. In a practical application, this oversize material and duct 71 are connected directly to the material inlet 31 of the clinkering furnace 3.

The duct 70 is connected at its lower end to a conveyor 75 which may be in the form of a fluidizing gravity conveyer of the type wherein gaseous fluid from a source (not shown) is blown up through a gas permeable bottom to aerate and fluidize material in the conduit so that it flows freely down a conduit having a slight slope. While similar apparatus has been used for conveying cement and cement raw meal which is at ambient temperature, utilization of such apparatus in conveying high temperature such as calcined cement raw meal is not generally utilized; see U.S. Pat. No. 2,527,455 for this type of apparatus, but for this application a high temperature gas permeable material is required to withstand the high temperatures. Use of this type of conveyor permits the system to have a lower overall height in general and specifically permits a reduction in the distance between the outlet of stage V vessel and the inlet 31 of the kiln 3. The conveyor 75 has an outlet end 76 which is flow connected to the riser duct 35 connecting the outlet 31 of the clinkering kiln 3 and the calcining furnace 2. The conveyor 75 has connected thereto another conduit 78 which supplies material from conduit 75 to the lower end of conduit 71 and the inlet 31 of the clinkering furnace 3. Material which is supplied through conveyor 75 to riser duct 35 is entrained in the hot kiln exhaust gases and recirculated to the calcining furnace 20 for further roasting or calcining.

The conduit 75 includes a adjustable gate 80 to control the fraction of material which is supplied through conduit 75 to outlet 76 and riser duct 3 (the recirculated material) and the fraction of material which is supplied through duct 78 to the duct 71 and inlet 31 of the clinkering furnace 3 (the discharged material). By adjusting the position of gate 80, the quantity of material directed to the duct 78 and therefore the quantity of material supplied to riser duct 35 can be controlled. As pointed out in U.S. Pat. No. 4,381,916, this quantity of material being recirculated through the calciner 2 may be as much as four times the quantity of new feed through inlet 25.

The duct 70, and conduit 75 may be referred to as means defining a second conduit flow connecting the material outlet 13 of the calcining furnace 2 with the riser duct 35 and thus the recirculation duct. Material which is supplied through this second conduit is entrained in the hot exhaust gases from the kiln and is recirculated to the calcining furnace 2. The hot exhaust gases from the kiln assist in calcining the material and raising the temperature inside the calciner 20. The conduit 70, 75, 78 and 71 define a first conduit for supplying calcined material from the material outlet 13 of the calcining furnace 2 to the material inlet 31 of the clinkering furnace 3. In the case of a simple calcining system which does not include a clinkering furnace material may be discharged from the system through duct 71.

In order to prevent the hot exhaust gases from the clinkering furnace 3 from being short circuited from riser duct 35 through conduits 71 and 75 to the outlet 13 of the gas solid separator 10 of stage V, a gas lock 90 is positioned in the conduit 75. This gas lock may be a one-way flap valve for permitting solid material to flow from the conduit 70 to the outlet 76 while preventing gas from flowing from 76 towards outlet 13. Similarly, a gas lock 92 is included in conduit 71 for preventing exhaust gas from flowing from inlet 31 through conduit 71 to the outlet 13.

The ducting arrangement of the present invention has the advantage that if there are large chunks of material being discharged from calcining furnace means through outlet 13 such as pieces of refractory tramp iron or agglomerations of calcined material, these large chunks will not pass through the grizzly 72 to the conduit 75, but instead will flow down enlarged conduit 71 to the inlet 31 of the clinkering furnace. This prevents such large pieces of material from blocking the conveying duct 75.

The arrangement of the present invention also has the advantage that in the event there is a plug or blockage in the recirculating duct 75, material may fill ducts 75 and 70 up to the point of the grizzly 72, and thereafter material will flow down through the oversize material duct 71 directly to the clinkering furnace 3. While such a plug would interfere with the advantageous recirculation of at least partially calcined material back to the calciner, the system could still operate producing satisfactory product until a scheduled shut-down and clean out was possible. The duct 71 may thus be referred to as a means for by-passing material around the recirculation means 75 and discharge ducts 71 and 78.

While the invention has been described primarily in connection with the manufacture of cement clinker, it us equally useful in the calcining of fine lime or dolomite or roasting of other ores. It may be practical where there is only utilized the calcining furnace and not the secondary clinkering furnace. In this case, the duct 71 would be connected to a cooling device to remove the calcined material from the system.

From the foregoing, it should be apparent that the objects of this invention have been carried out. It is intended that the present invention be limited solely by that which is within the scope of the appended claims.

We claim:

1. Apparatus for producing cement clinker comprising a preheater; a calcining furnace means having a material inlet and a material outlet; a clinkering furnace having a material inlet and a material outlet and a cooler wherein fuel is supplied to and combustion takes place within both of said calcining furnace and said clinkering furnace and cement raw meal is preheated in said preheater by means of exhaust gases from at least one of said calcining furnace and said clinkering furnace and sequentially supplied from said preheater to said calcining furnace, clinkering furnace and said cooler; a riser duct for supplying exhaust gas from the clinkering furnace to the calcining furnace means; means defining a first conduit for supplying calcined material from the material outlet of calcining furnace means to the material inlet of the clinkering furnace; means for recirculating at least a portion of the cement raw meal from the material outlet of the calcining furnace means through the calcining furnace means before it is supplied to the clinkering furnace including means defining a second conduit flow connecting the material outlet of the calcining furnace means with the riser duct; said second conduit being a fluidizing gravity conveyor and means defining a third conduit for by-passing some material directly to the clinkering furnace around said first and second conduits.

2. Apparatus for producing cement clinker according to claim 1, further comprising means associated with said second conduit for separating coarse particles from the calcined material and said third conduit supplies said coarse particles directly to the clinkering furnace.

3. Apparatus for producing cement clinker according to claim 2, further comprising a gas lock mounted for substantially preventing exhaust gas from said kiln from passing from said riser duct through said means defining a first conduit and said means defining a second conduit to the material outlet of the calcining furnace.

4. Apparatus for producing cement clinker according to claim 3, further comprising said gas lock is mounted in said second conduit and a second gas lock is mounted in said means defining a third conduit for substantially preventing exhaust gas from said riser duct from passing from said riser duct through said third conduit to the material outlet of the calcining furnace.

5. Apparatus for producing cement clinker according to claim 4 further comprising said third conduit being positioned in relation to said first and second conduits for permitting substantially all of the calcined material to flow through said third conduit in the event of a blockage in said second conduit.

6. Apparatus for producing cement clinker according to claim 5 wherein said means for separating large particles is a grizzly mounted between said second conduit and the third conduit below the outlet of said calcining furnace means so that fine material passes through said grizzly to said second conduit and coarse material is supplied to said third conduit.

7. Apparatus for roasting fine grained material such as cement raw meal, lime or dolomite comprising a furnace having an inlet for gas for combustion, an inlet for raw fine grained material to be roasted, an inlet for fuel for combustion in said furnace and an outlet for spent combustion gas and at least partially roasted fine grained material; a gas-solids separator having an inlet for spent combustion gas and at least partially roasted fine grained material flow connected to the outlet of said furnace, an outlet for separated at least partially roasted fine grained material and an outlet for separated spent combustion gas; means for recirculating a portion of the at least partially roasted fine grained material from the outlet for separated at lest partially roasted fine grained material of said gas-solids separator to said furnace and for discharging the remainder of the at least partially roasted fine grained material; means for by-passing material around said means for recirculating a portion of the material for discharging bypassed material form the system; and means for separating coarse particles from the at least partially roasted fine grained material and for discharging said coarse particles through said means for by-passing material and for permitting the remaining at least partially roasted fine grained material to be supplied to said means for recirculating material.

8. Apparatus for roasting fine grained material according to claim 7 further comprising means for further processing the roasted fine grained material including means for generating a hot gas, means for supplying the thus generated hot gas to the furnace, and said means for recirculating a portion of the at least partially roasted fine grained material to the furnace is connected to said means for supplying the thus generated hot gas to the furnace.

9. Apparatus for roasting fine grained material according to claim 8 further comprising a gas lock mounted in said means for recirculating for substantially preventing hot gas from the means for further processing the roasted material from being supplied to the outlet for separated material of the gas-solids separator.

10. Apparatus for roasting fine grained material according to claim 9 wherein said means for separating large particles includes a grizzly mounted near the outlet of said gas-solids separator.

11. Apparatus for roasting fine grained material such as cement raw meal, lime or dolomite comprising a furnace having an inlet for gas for combustion, an inlet for raw fine grained material to be roasted, an inlet for fuel for combustion in said furnace and an outlet for spent combustion gas and at least partially roasted fine grained material; a gas-solids separator having an inlet for spent combustion gas and at least partially roasted fine grained material flow connected to the outlet of the furnace, an outlet for separated at least partially roasted fine grained material and an outlet for separated spent combustion gas; means for further processing the roasted fine grained material discharged from said gas-solids separator; means defining a first conduit for supplying material from the material outlet of the gas-solids separator to the said means for further processing the material; means for recirculating a portion of the at least partially roasted fine grained material from the outlet for separated at least partially roasted fine grained material of the gas solids separator to said furnace including means defining a second conduit flow connecting the material outlet of the gas-solids separator with the material inlet of the furnace; and means defining a third conduit for by-passing material directly from the gas solids separator to said means for further processing the roasted fine grained material around said first and second conduits.

12. Apparatus for roasting fine grained material comprising a furnace means having a material inlet and a material outlet wherein fuel is supplied to and combustion takes place within said furnace; means for further processing material discharged from the said furnace means; means defining a first conduit for supplying material from the material outlet of said furnace means to said means for further processing the material; means for recirculating at least a portion of the material from the material outlet of the furnace means through said furnace means before it is supplied to the means for further processing the material including means defining a second conduit flow connecting the material outlet of the furnace means with the material inlet of the furnace means; and means defining a third circuit for by-passing material from said furnace means directly to the means for further processing the material around said first and second conduits.

* * * * *